US011629940B2

(12) United States Patent
Peron

(10) Patent No.: US 11,629,940 B2
(45) Date of Patent: Apr. 18, 2023

(54) CIRCUIT FOR CONTROLLING THE FIRING OF A PYROTECHNIC COMPONENT

(71) Applicant: NEXTER MUNITIONS, Versailles (FR)

(72) Inventor: Jean-Luc Peron, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 17/621,520

(22) PCT Filed: Jun. 15, 2020

(86) PCT No.: PCT/IB2020/055577
§ 371 (c)(1),
(2) Date: Dec. 21, 2021

(87) PCT Pub. No.: WO2020/254943
PCT Pub. Date: Dec. 24, 2020

(65) Prior Publication Data

US 2022/0349686 A1 Nov. 3, 2022

(30) Foreign Application Priority Data

Jun. 21, 2019 (FR) ..... 1906632

(51) Int. Cl.
*F42B 3/12* (2006.01)
*F42D 1/05* (2006.01)

(52) U.S. Cl.
CPC ..... *F42B 3/121* (2013.01); *F42B 3/124* (2013.01); *F42D 1/05* (2013.01)

(58) Field of Classification Search
CPC ..... F42B 3/121; F42B 3/122; F42B 3/124; F42C 11/002; F42C 19/12; F42D 1/05; F42D 1/045
See application file for complete search history.

(56) References Cited

U.S. PATENT DOCUMENTS 3,001,477 A * 9/1961 Ruehlemann ..... F42C 11/06 102/211
3,953,804 A * 4/1976 Dethlefsen ..... H03K 5/1502 327/396
3,958,510 A * 5/1976 Stutzle ..... F42C 17/04 102/209
4,068,592 A * 1/1978 Beuchat ..... F42C 11/04 102/215

(Continued)

OTHER PUBLICATIONS

Barry T. Neyer. "A D-Optimality-Based Sensitivity Test". Technometrics, Feb. 1994, vol. 36, No. 1, pp. 61-70.

(Continued)

*Primary Examiner* — Joshua E Freeman
(74) *Attorney, Agent, or Firm* — Oliff PLC

(57) ABSTRACT

A circuit for controlling the firing of an exploding-foil pyrotechnic component including at least one capacitor and switch means, the capacitor being connected to the pyrotechnic component by an array of at least three diodes connected in series and in a direction that prevents the capacitor from discharging, the sum of the reverse voltages of these diodes being greater than the maximum voltage that can be delivered by the capacitor, the switch means including at least two field-effect transistors associated with the array of diodes.

4 Claims, 2 Drawing Sheets

(56) References Cited

U.S. PATENT DOCUMENTS

| | | | | | |
|---|---|---|---|---|---|
| 4,559,875 | A * | 12/1985 | Marshall | F42C 11/00 | 102/206 |
| 4,651,646 | A * | 3/1987 | Foresman | F42C 11/04 | 102/206 |
| 4,700,263 | A * | 10/1987 | Marshall | F42C 11/00 | 361/251 |
| 4,788,913 | A * | 12/1988 | Stroud | F42B 3/11 | 102/202.5 |
| 4,858,530 | A * | 8/1989 | Edminister | F42C 15/40 | 102/208 |
| 4,862,803 | A * | 9/1989 | Nerheim | F42B 3/13 | 102/202.7 |
| 4,993,322 | A * | 2/1991 | Boucard Jean | F42C 19/095 | 102/270 |
| 5,898,122 | A * | 4/1999 | Davis | B60R 21/017 | 102/206 |
| 6,138,571 | A * | 10/2000 | Denney | F42C 11/008 | 102/206 |
| 10,670,381 | B1 * | 6/2020 | Anderson | F42B 39/14 | |
| 2012/0012020 | A1 * | 1/2012 | Remahl | F42C 11/065 | 102/210 |
| 2015/0040786 | A1 * | 2/2015 | Overbey | F42C 11/002 | 102/202.7 |
| 2018/0224248 | A1 * | 8/2018 | Lerche | F42D 1/043 | |

OTHER PUBLICATIONS

Mar. 18, 2020 Search Report and Written Opinion issued in French Patent Application No. 1906632.

Sep. 25, 2020 International Search Report issued in International Patent Application No. PCT/IB2020/055577.

Sep. 25, 2020 Written Opinion issued in International Patent Application No. PCT/IB2020/055577.

* cited by examiner

CIRCUIT FOR CONTROLLING THE FIRING OF A PYROTECHNIC COMPONENT

The technical field of the invention is that of firing control circuits for exploding-foil pyrotechnic components.

The exploding-foil pyrotechnic components are most often known under the English name of "slappers". They comprise a fusible bridge that, when a current is passed through it, generates a plasma which projects a thin layer of plastic or metallic material against an explosive relay.

The advantage of slappers is that they can be used to make detonators without primary explosives, which improves safety of operation. These components are well known, for example from patents U.S. Pat. Nos. 4,788,913 and 4,862,803.

The firing control circuits of such components usually include a capacitor charged by a generator, which makes it possible to provide a pulse discharge current having both a high voltage (from 800 to 1450 Volts) and a high current, of the order of 1500 Amps.

Generally the firing switch is a static component, of the thyristor type, which operates in avalanche mode, which allows the passage of a high current.

One of the disadvantages of thyristors is that they require special control voltages, which means that current transformers have to be provided, reducing the compactness of the ignition control circuit.

In addition, the reliable implementation of slappers requires prior destructive testing of the entire pyrotechnic train in order to determine the voltage necessary, for a whole given range of temperatures, for the correct operation of the slapper with a given confidence rate and reliability rate.

These tests (called Neyer tests) are well known in the field of statistical analysis, in particular for pyrotechnic components.

One can for example consult the publication: "A D-Optimality-Based Sensitivity Test"—Author: Barry, T Neyer, republished from TECHNOMETRICS 02/1994, Vol 36, No. 1, page 61-70. Available on the internet at:

http://neyersoftware.com/Papers/D-Optimal/D-Optimal.htm

Conducting these tests on a sample of a batch of circuits makes it possible to set the firing voltage that will ensure the desired reliability for the batch and for a given application.

The tests thus classify a complete initiation train associating: slapper, capacitor and static switch.

However, compact and cheap static switches, such as MOS transistors, are not destroyed in avalanche mode for voltages of the order of 1350 Volts maximum, which are used for slappers. This results in a current intensity that is insufficient for the proper functioning of the slapper and a difficulty in characterizing the reliability of the complete initiation chain.

Furthermore, the range of variation of the slapper control voltage is limited (approximately between 1300 volts and 1450 volts) whereas the desired reliability performance may require a lower firing voltage, particularly in the range of 800 volts to 1450 volts.

It is the object of the invention to provide a firing control circuit of simple and compact structure that can operate in a wide voltage range (from 800 volts to 1450 volts) while allowing statistical tests on samples to define a firing voltage ensuring a desired reliability level according to the Neyer tests.

Thus, the object of the invention is a circuit for controlling the firing of an exploding-foil pyrotechnic component, the circuit comprising at least one capacitor that can be discharged in the pyrotechnic component in order to initiate it and a switch means ensuring the discharge of the capacitor in the pyrotechnic component, a control circuit characterized in that the capacitor is connected to the pyrotechnic component by an array of at least three diodes connected in series and in a direction that prevents the discharge of the capacitor, the sum of the reverse voltages of these diodes being greater than the maximum voltage that can be delivered by the capacitor, the switching means comprising at least two field effect transistors whose gates can be controlled simultaneously and which are associated with the diode array, each transistor being connected by one of its outputs between two diodes of the array, the control of the transistors causing the successive short-circuits of the three diodes and the firing.

Advantageously, each diode can be associated with a resistor connected in parallel, which makes it possible to limit and set the reverse voltage to which each diode is subjected.

According to a particular embodiment, each transistor can be connected between two diodes by means of a resistor, which makes it possible to limit the current circulating in the transistors.

Advantageously, the transistors can be MOS transistors. But the invention can be implemented with other types of transistors.

The invention will be better understood from the following description of a particular embodiment, which is made with reference to the appended drawings in which.

Figure 1:
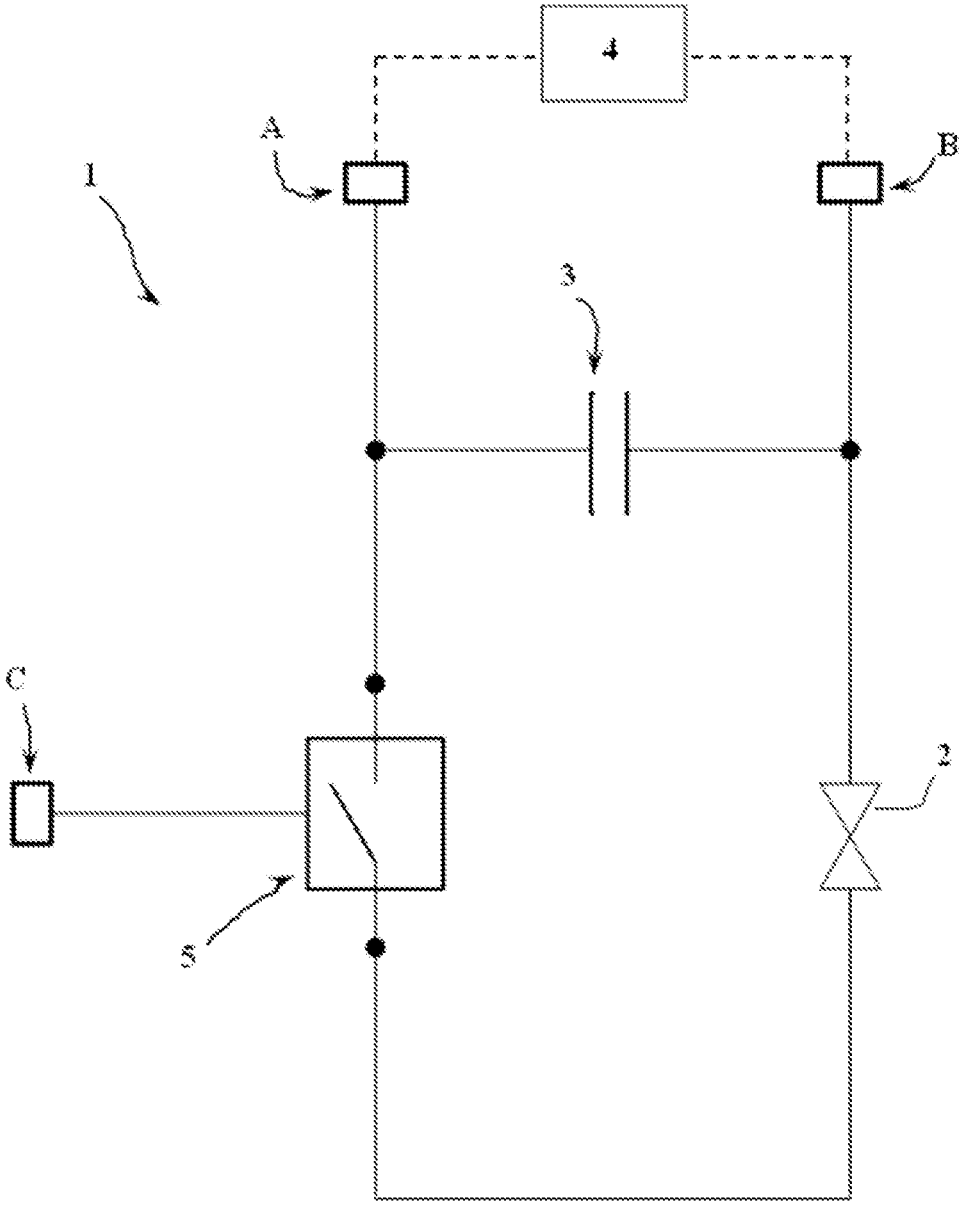
PRIOR ART Fig. 1
FIG. 1 shows a firing control circuit according to the prior art.

Referring to FIG. 1, a known firing control circuit 1 comprises an exploding-foil pyrotechnic component (or slapper) 2 that can be initiated by the discharge of a capacitor 3. The capacitor 3 is charged by a generator 4, which is arranged between its input pins A and B. If the slapper 2 is incorporated in a projectile, the charging of the capacitor 3 occurs at a given moment on the trajectory of the projectile, for example, or following the firing of this projectile.

The charge of the capacitor 3 is carried out at a voltage level that ensures operation at the desired reliability level according to the Neyer tests.

The firing control circuit 1 also comprises a static switch means 5, such as a thyristor, which, upon its controlled closure by the contact C, will cause the discharge of the capacitor 3 in the slapper 2.

Figure 2:
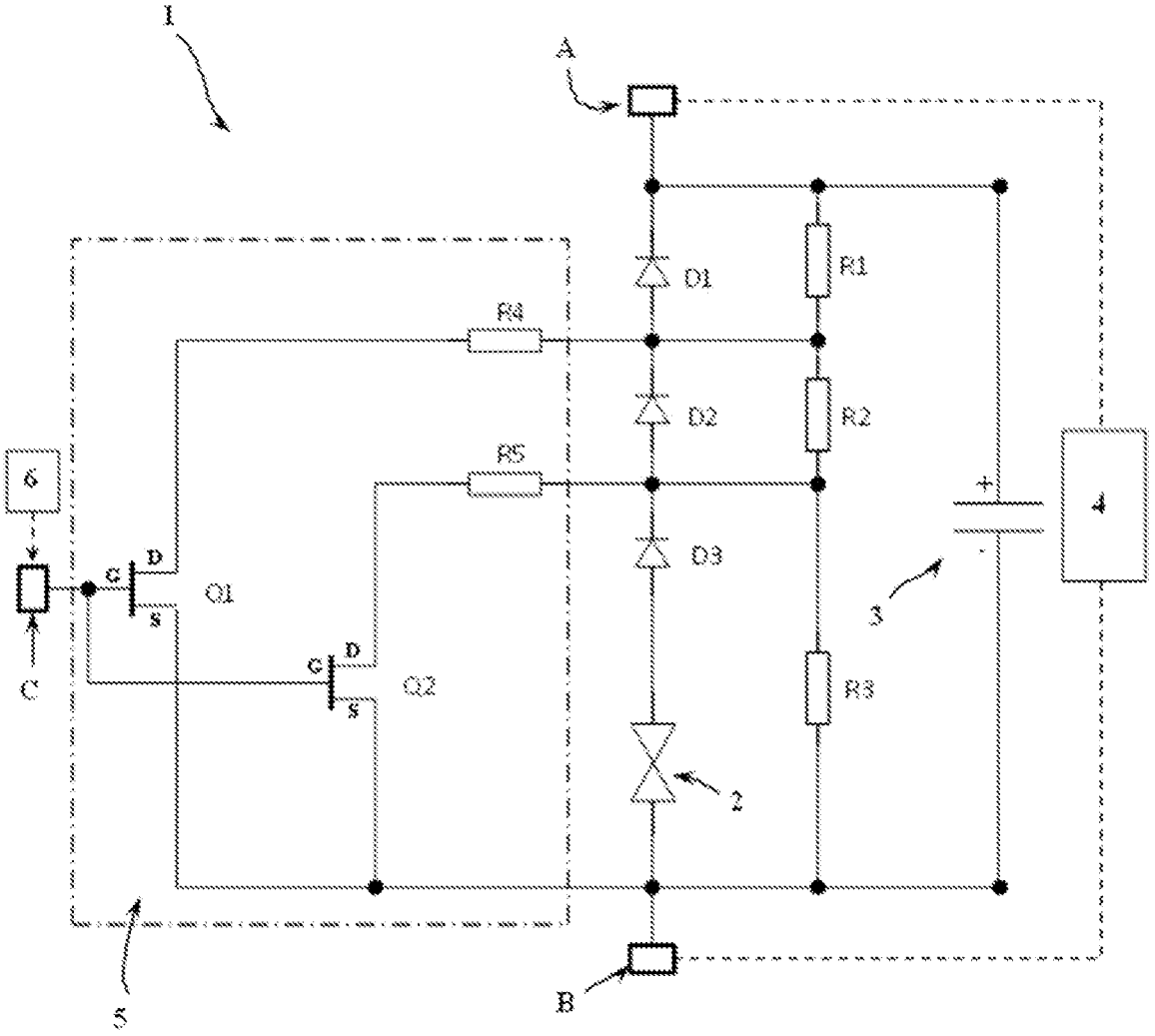
FIG. 2 shows a firing control circuit according to an embodiment of the invention.

FIG. 2 shows an embodiment of a firing control circuit 1 according to one embodiment of the invention.

The elements of this circuit that perform the same functions as those of the known circuit are designated by the same reference numerals.

It can be seen that the capacitor 3 can again be charged by a generator 4 from the input pins A and B.

The control circuit 1 comprises three diodes D1, D2 and D3 connected in series and in reverse (in a direction that prevents the discharge of the capacitor). These diodes form an array that connects the slapper 2 and the capacitor 3.

The diodes D1, D2 and D3 are connected in a direction that prevents the discharge of the capacitor 3 (the cathode (+) of the capacitor 3 is connected to the blocking pole or cathode of the diode Dl).

The pin B that is connected to the anode (−) of the capacitor 3 constitutes the common pole (0 volts) of the circuit 1.

Moreover, the sum of the reverse voltages of these diodes is greater than the maximum voltage that can be delivered by the capacitor 3.

There can therefore be no discharge of the capacitor 3 in the slapper 2.

As an example, for a capacitor whose maximum charge is achieved at a voltage of 1450 Volts, diodes with a reverse voltage of 600 Volts can be adopted. Thus, when the three diodes are connected in series, the overall reverse voltage of the circuit is 1800 volts and the capacitor 3 does not discharge.

It should be noted that, given the reverse voltage values of diodes on the market and the voltage ranges required to initiate a slapper, it is necessary to implement at least three diodes for this circuit.

As shown in FIG. 2, each diode D1, D2 or D3 is associated with a resistor (R1, R2 or R3 respectively), which is connected in parallel with the diode.

With the previously mentioned voltage values, these resistors have a value of about 10 Mega-Ohms (10 MΩ). Each resistor limits the reverse voltage to which each diode is subjected when the capacitor 3 is charged. Here the reverse voltage is limited to 485 volts for each diode, which is less than the reverse voltage of a diode (600 volts). Therefore, there can be no short-circuit of the diode.

It should be noted that if one or more of these resistors R1 to R3 were omitted, the voltage across the diode without a resistor would be associated with the sole reverse impedance of the diode considered. As all diodes are not strictly identical, this could lead to the appearance of a voltage higher than the reverse voltage (600 Volts) across the terminals of this diode, leading to undesired destruction. The resistors connected in parallel to the diodes make it possible both to limit and set the reverse voltage to which each diode is subjected.

As far as the diode D3 is concerned, it should be noted that the resistor R3 is in parallel not with diode D3 alone, but with the circuit of the diode D3 in series with slapper 2. This has no practical consequences, as the resistance of slapper 2 is negligible.

According to the invention, the switching means 5 comprises at least two field effect transistors, Q1 and Q2, whose gates G can be controlled simultaneously by a control logic circuit 6 connected to the contact C.

Each transistor is connected by one of its outputs D between two diodes of the array.

Thus the output D of the transistor Q1 is connected between the diodes D1 and D2 via a resistor R4.

The output D of the transistor Q2 is connected between the diodes D2 and D3 via a resistor R5.

The S gates of each transistor Q1 and Q2 are also connected to the common pole of the circuit connecting the slapper 2 and the anode (−) of the capacitor 3 (contact B).

The transistors Q1 and Q2 are of MOS technologies. These components are inexpensive and easy to control from a programmable logic type circuit 6.

Such a circuit makes it possible to cause successive short-circuits of the three diodes, by the simultaneous control of the transistors, leading to the firing of the slapper 2.

An initiation of the slapper 2 is obtained here by avalanche of the diodes, thus with a strong current guaranteeing the initiation without the transistors Q1 and Q2 themselves being put in avalanche.

The operation is as follows:

When controlling the two transistors Q1 and Q2, the first transistor Q1 connects the point between the two diodes D1 and D2 to the common pole B (0 volts). As a result, the diode D1 is subjected to a reverse voltage equal to the charging voltage of the capacitor 3. This voltage can vary between 800 Volts and 1450 Volts and, in all cases, it is higher than the reverse voltage of the diode D1, which is 600 Volts.

The diode D1 is then short-circuited (avalanche effect). Moreover, the switching of the second transistor Q2 has connected the point separating the diodes D2 and D3 to the common pole (0 volts). As the diode D1 is short-circuited, it is now the diode D2 that is subjected to the charging voltage of the capacitor 3. This second diode D2 is then also short-circuited and finally the diode D3 is subjected to the charging voltage of the capacitor 3 and is in turn short-circuited, thus connecting an input of the slapper 2 directly to the cathode (+) of the capacitor 3, the other input of the slapper being connected to the common pole B of the circuit 1.

A successive avalanche of the three diodes is thus obtained, leading to the initiation of the slapper 2 for a charging voltage of the capacitor 3 that can vary between 800 volts and 1450 volts.

The resistors R4 and R5 are chosen to be around 27 Ohms. They make it possible to limit the current flowing in the transistors, in particular during the avalanche. Thus all the energy contained in the capacitor 3 will indeed flow towards the slapper 2.

It is of course possible to define a circuit with more than 3 diodes in series, to implement diodes with lower reverse voltages, for example. Other transistors could then be associated to command the other avalanches. If N is the number of diodes Di used, the number of transistors Qi required is equal to N−1.

It can thus be seen that the device according to the invention makes it possible to use static components with MOS technology without the need to destroy the MOS by avalanche effect during an initiation at a low voltage (such as 800 volts).

With the arrangement proposed by the invention, it is possible to conduct statistical destructive tests (Neyer tests) of a sample of a series of circuits in order to determine the optimal voltage to ensure the operation of the other circuits of the same series with a given confidence and reliability rate.

Even if the required voltage is low, the avalanche effect will still be ensured by the diode arrangement.

In this way, compact and inexpensive firing control circuits could be made and the desired levels of reliability could be achieved.

The invention claimed is:

1. A circuit for controlling firing of an exploding-foil pyrotechnic component, the circuit comprising at least one capacitor configured to be discharged in the pyrotechnic component in order to initiate the pyrotechnic component, and switch means ensuring discharge of the capacitor in the pyrotechnic component, wherein the capacitor is connected to the pyrotechnic component by an array of at least three diodes connected in series and in a direction that prevents the discharge of the capacitor, a sum of reverse voltages of the at least three diodes being greater than a maximum voltage that can be delivered by the capacitor, the switching means comprising at least two field effect transistors, gates of the at least two field effect transistors being configured to be controlled simultaneously, the at least two field effect transistors being associated with the diode array, one of an output of each transistor being connected between two diodes of the array, a control of the transistors causing successive short-circuits of the three diodes and the firing.

2. The circuit for controlling the firing according to claim 1, wherein each diode is associated with a resistor connected in parallel to limit and set a reverse voltage to which each diode is subjected.

3. The circuit for controlling the firing according to claim 2, wherein each transistor is connected between two diodes by means of a resistor to limit the current flowing in the transistors.

4. The circuit for controlling the firing according to claim 1, wherein the transistors are MOS transistors.

* * * * *